US008111843B2

(12) United States Patent
Logalbo et al.

(10) Patent No.: US 8,111,843 B2
(45) Date of Patent: Feb. 7, 2012

(54) COMPENSATION FOR NONUNIFORM DELAYED GROUP COMMUNICATIONS

(75) Inventors: Robert D. Logalbo, Rolling Meadows, IL (US); Tyrone D. Bekiares, Chicago, IL (US); Donald G. Newberg, Hoffman Estates, IL (US)

(73) Assignee: Motorola Solutions, Inc., Schaumburg, IL (US)

( * ) Notice: Subject to any disclaimer, the term of this patent is extended or adjusted under 35 U.S.C. 154(b) by 713 days.

(21) Appl. No.: 12/268,864

(22) Filed: Nov. 11, 2008

(65) Prior Publication Data

US 2010/0119083 A1 May 13, 2010

(51) Int. Cl.
*H04R 3/00* (2006.01)
*H04R 1/40* (2006.01)
*H04R 29/00* (2006.01)

(52) U.S. Cl. ..... 381/111; 381/97; 381/56

(58) Field of Classification Search ..... 381/56, 381/97, 111

See application file for complete search history.

(56) References Cited

U.S. PATENT DOCUMENTS

| | | | | |
|---|---|---|---|---|
| 7,720,232 | B2 * | 5/2010 | Oxford | 381/66 |
| 7,894,511 | B2 * | 2/2011 | Zurek et al. | 375/220 |
| 2006/0013407 | A1 * | 1/2006 | Peavey et al. | 381/56 |
| 2008/0037674 | A1 | 2/2008 | Zurek | |

OTHER PUBLICATIONS

Fred Cummins, "Measuring Synchronization Among Speakers Reading Together", In Proc. ISCA Workshop on Experimental Linguistics, pp. 105-108, Athens, Greece, Aug. 28-30, 2006.

Wehr, et al., "Synchronization of Acoustic Sensors for Distributed Ad-Hoc Audio Networks and its use for Blind Source Separation", Proceedings of the IEEE Sixth International Symposium on Multimedia Software Engineering (ISMSE'04), 0-7695-2217-3/04, 2004.

* cited by examiner

*Primary Examiner* — Luan C Thai

(74) *Attorney, Agent, or Firm* — Anthony P. Curtis; Daniel R. Bestor

(57) ABSTRACT

A method for synchronizing audio reproduction in collocated end devices is presented. Each of the devices auto-correlates using noise to determine a threshold prior to the antenna receiving an audio signal. When the devices receive a common audio signal, they provide audio outputs. Each device cross-correlates its audio output with the audio outputs of the other devices. The timing of the audio output of each device is then adjusted such that the audio outputs of all of the devices align temporally with the lagging or leading device.

20 Claims, 6 Drawing Sheets

COMPENSATION FOR NONUNIFORM DELAYED GROUP COMMUNICATIONS

TECHNICAL FIELD

The present application relates to group communications. In particular, the application relates to simultaneous reproduction of an audio signal in a group communication.

BACKGROUND

Group-directed communications are commonplace in enterprise and public safety communication systems. With regard to voice communications, one end device directs an audio stream (i.e., a "talkburst") to a given group (i.e. a "talkgroup") of receiving end devices. These receiving end devices reproduce the audio stream through an amplified speaker. The manner in which the receiving end devices operate usually results in the reproduced sound being audible to people other than merely the intended recipient. Typically, in these group-based systems, the receiving end devices are located near each other, causing their associated listeners to hear the same audio stream reproduced by multiple end devices. This is particularly true in public safety uses, in which personnel often respond to incidences in a group and this group (or a subset thereof) is located in the same local area for an extended period of time.

In order to ensure the audio stream is intelligible to the intended listeners in such an environment, it is desirable for collocated devices to reproduce the audio stream in a time synchronized fashion. In other words, it is desirable for all speakers in the collocated devices to reproduce the same audio waveform at roughly the same time. In practice, a temporal offset of about 30 ms or so between multiple audible speakers reproducing the same waveform is virtually undetectable to most listeners.

Synchronization methods for the homogeneous circuit-based wireless radio area networks (RANs) of the current generation of enterprise and public safety communication systems are unlikely to provide acceptable results in future generations of RANs, which are likely to span multiple narrowband circuit-switched and broadband packet-based broadband technologies. A variety of delays exist in such networks causing spreading and jitter problems. Sources of these problems include different amounts of time for different destination end devices to be paged and activated, packet duplication and retries in broadband wireless networks, and multitasking processing delays. Without a mechanism to compensate for the combined new and existing sources of destination-specific delay and jitter, each end device will reproduce audio in an autonomous fashion. This results in unintelligibility when two or more end devices are collocated.

BRIEF DESCRIPTION OF THE DRAWINGS

Embodiments will now be described by way of example with reference to the accompanying drawings, in which.

DETAILED DESCRIPTION

Figure 1:
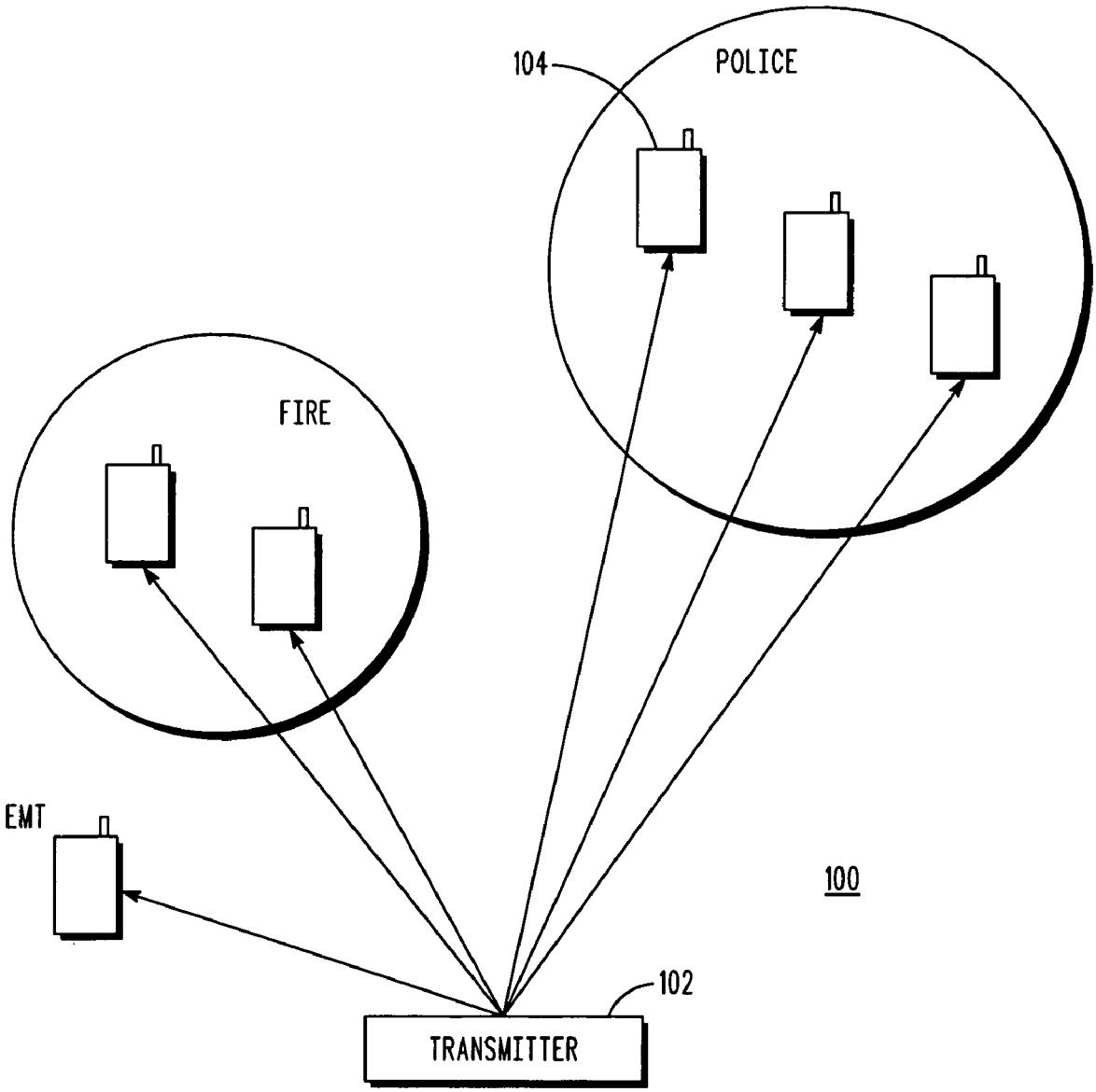
FIG. 1 illustrates one embodiment of a network.

Methods of compensating for non-uniform delays in group communications to coordinate audio reproduction are presented. A collocated homogeneous or heterogeneous group of end devices each have a processor, an antenna, a speaker, and multiple microphones. Audio emitted from the end devices may have delay phase responses that vary to a great enough extent to result in interference substantial enough to impair intelligibility. Compensation algorithms are used to time align the presentation time of such audio. The processor cross-correlates an audio stream received by the antenna with an audio stream received by one or more of the microphones of the end device and emitted from speakers of the collocated end devices. The processor in each of the collocated end devices determines the most delayed audio stream of the audio stream produced by the collocated end devices and uses a time shifting algorithm to delay the audio stream of its own output to that of the most delayed audio stream to synchronize audio reproduction of the collocated end devices. The reproduced audio from all of the end devices has a relatively small phase offset with respect to each other. The situations in which collocated media presentations may be used include one-to-many communication systems, two-way communication systems, and event sound reinforcement. Attenuation control of the speaker output may additionally or alternatively be provided.

As used herein, subscribers (also called end devices) are communication devices such as mobile radios that all receive the same audio stream from a transmitter. Each subscriber selects a particular channel through one or more user-actuated selectors for reproduction using one or more speakers. The subscriber is personally portable or mounted on a vehicle. The subscriber contains multiple microphones including a microphone for the user to speak into and a noise cancelling microphone.

Speaker audio is an acoustic audio stream played or sourced out of a speaker of a receiver or digital audio presented to the speaker. This audio stream can be received by a subscriber from various networks such as a broadband network, a narrowband network, or a personal area network (PAN). The speaker audio is not received from the noise cancelling microphone. This audio stream is represented as $x_N(m)$ in the cross-correlation calculation below. A PAN can be based on bluetooth or 802.11 and usually has a small coverage radius, e.g., up to about a hundred meters.

An audio source is an audio stream that has been received over the broadband network, narrowband network, PAN, digitally sampled from a noise cancelling microphone, etc. . . . This audio stream is represented as y(m) in the cross correlation calculation below.

A transmitter is a subscriber or other communication device (such as a central controller) that transmits a media stream containing audio.

A receiver receives the audio stream either directly from the transmitter or through wireless or wired communication infrastructure such as one or more intermediaries such as base stations and reproduces the speaker audio.

Collocated subscribers are end devices that are disposed in a relatively small area (e.g., a radius of up to about 100 meters) such that audio reproduction from one of the subscribers is able to audibly interfere with audio reproduction from another of the subscribers significantly enough to negatively influence the experience of the user of the other subscriber. Proximity is the distance between receivers whose speaker audio may interfere. This is detectable by a subscriber with a digital indication from infrastructure equipment or other subscribers through a narrowband, broadband, 802.11, Bluetooth, etc. radio link. It may also be indicated by energy that exceeds a nominal noise threshold on the noise cancelling microphone.

Homogeneous end devices are end devices of the same general type (e.g., push-to-talk devices), but not necessarily the same model. Heterogeneous end devices are end devices of different types (cell phones vs. push-to-talk radios).

An incidence is an event, such as an accident, in proximity to which collocated subscribers are gathered.

The cross-correlation calculation is described by the equation:

$$c_N(n) = \sum_{m=0}^{M} y(m) * x_N(n+m)$$

The terms $x_N(m)$ and y(m) are, respectively, the audio stream intended to be presented to the speaker and not intended to be presented to the speaker (e.g., the audio stream received from the noise canceling microphone). Interference is observed when the cross-correlation calculation is executed and peak(s) exceeding a threshold are detected. This indicates the audio streams being reproduced from the subscriber speakers interfere with each other if at least one subscriber's speaker audio is significantly delayed (e.g., >about 250 msecs) from another subscriber's speaker audio.

In various embodiments described below, audio reproduction compensation algorithms are used if interferers with a subscriber are detected. Subscribers at an incidence scene that have widely varying audio delays (>about 250 ms) may be interferers. The use of a compensation algorithm enables subscriber users at the incidence scene to understand the reproduced audio stream if interferers are present. The compensation algorithm uses cross-correlation to determine the most delayed or lagged audio stream and take action. Compensation algorithms include both delay sensitive and delay insensitive compensation algorithms. Both types of algorithms are also called time-shifting algorithms.

If an interferer is detected and the subscriber is configured to only use delay sensitive compensation algorithms, the audio presented to the leading speaker (the speaker reproducing the speaker audio earlier) may or may not be delayed depending on the amount of delay detected. If the interferer delay with respect to subscriber is small (within a delay-sensitive compensation lag threshold of, e.g., 30, 50, or 100 ms or anywhere therebetween), the audio presented to the speaker remains unaltered. If the delay of the interferer with respect to subscriber is large (greater than the lag threshold), the audio presented to the speaker of the subscriber is delayed or attenuated/muted.

If an interferer is detected and the subscriber is configured to only use delay insensitive compensation algorithms, the audio presented to the leading speaker is compensated with a delay insensitive compensation algorithm. One such algorithm delays the audio to be presented to the speaker by the delay calculated in the cross-correlation calculation. Thus, if any phase offset is present, the speaker audio is delayed by the amount determined by the cross-correlation. Another algorithm delays the audio to be presented to the leading speaker by a fixed amount.

One embodiment of a one-to-many network is shown in FIG. 1. As shown, a transmitter 102 transmits an audio stream (also referred to herein as a talkburst), which is received by one or more receivers 104 connected via one or more wireless or wired communication networks. The receivers 104 are part of the same talkgroup as the transmitter 102 and can transmit messages to and receive messages from all other members of the talkgroup who have selected the appropriate channel using, e.g., a dial on the receiver 104. The transmitter 102 and receivers 104 may be end devices, such as push-to-talk (PTT) devices, controllers, etc. The transmitter 102 and receivers 104 may belong to different groups such as public safety groups (as shown police, fire, and emergency medical personnel). Other network elements such as base stations, routers, repeaters et al. that may be disposed between the transmitter 102 and the receivers 104 are not shown for convenience.

In one embodiment of a one-to-many transmission, the transmitter 102 initiates a talkburst and sends the talkburst to a base station, which then transmits the talkburst to a controller. The controller forwards the talkburst to a base station. The controller provides time stamping of the talkburst. Depending on the embodiment, the base station transmits the talkburst to the appropriate receivers 104 at the time indicated by the time stamp or when it receives the talkburst independent of the time stamp. Real-time Transport Protocol/Real-time Transport Control Protocol (RTP/RTCP), the dominant protocol used to deliver streaming media over packet IP networks is able to specify timestamps. This mechanism, however, only indicates the relative time at which a particular media sample was captured, and not the absolute time at which it is to be reproduced. Moreover, the inclusion of an absolute timestamp in periodic RTCP messages only provides synchronization across multiple streams to a single endpoint (e.g. audio and video lip synchronization), and not synchronization of the same stream to multiple endpoints. Additionally, the RTCP wall clock time is sent only periodically, and may not be available at the time the initial packet is reproduced.

Figure 2:
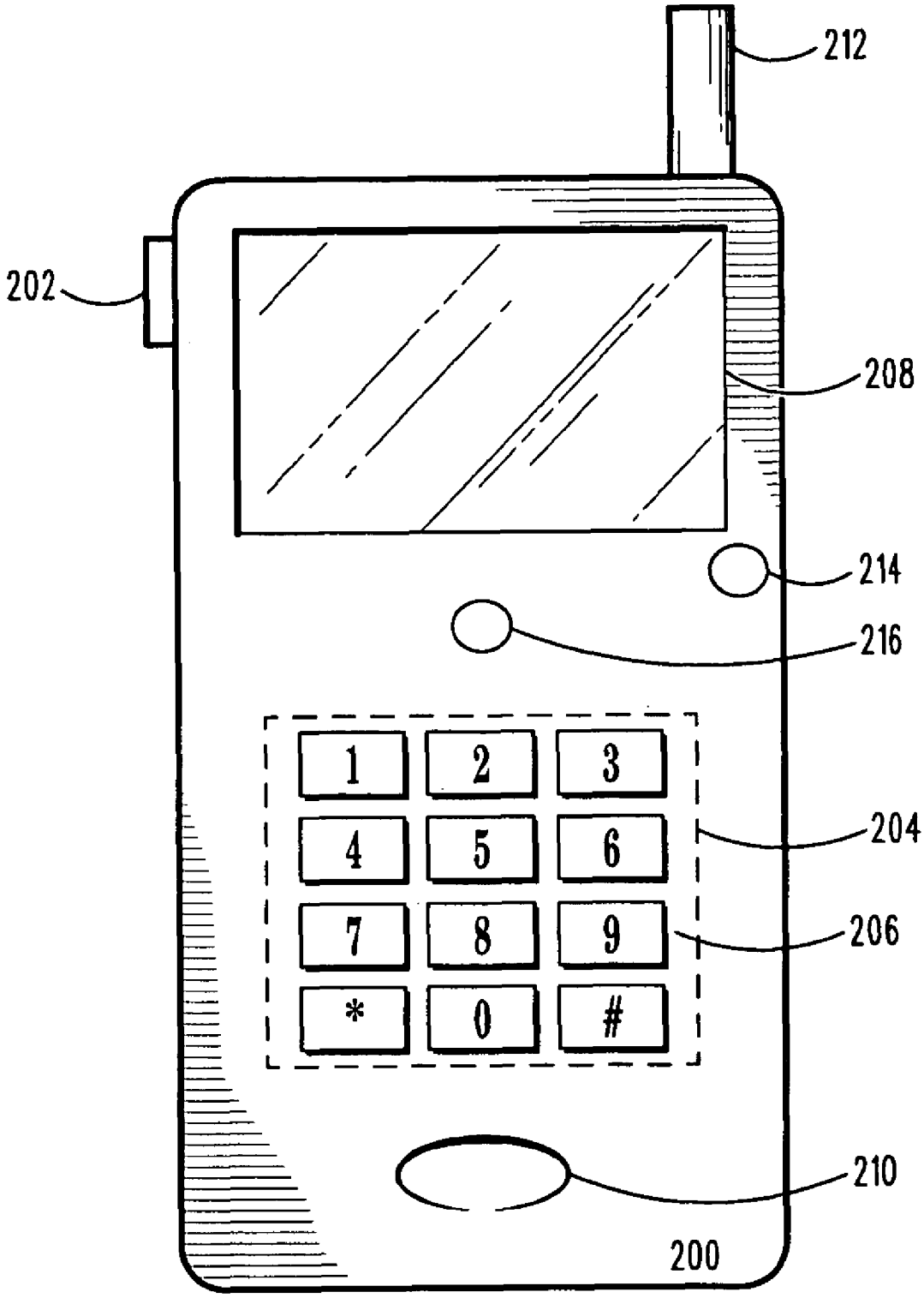
FIG. 2 illustrates an embodiment of an end device in the network of FIG. 1.

One embodiment of the front of a PTT end device used in the network of FIG. 1 is shown in FIG. 2. The PTT device 200 includes a PTT button 202, an alpha-numeric keypad 204 containing keys 206, a microphone 210, an internal and/or external antenna 212, a channel selector 214, a speaker 216, and, optionally, a display 208 and/or a touch panel (not shown). One or more other microphones may be positioned at a different position on the PTT end device 200, either on the front, one of the sides, or the back. The PTT button 202 permits the handset 200 to initiate a talkburst when manually pressed and receive talkbursts when depressed. The display 208 displays information such as group identification, transmission and reception frequencies, time/date, remaining power, incoming and dialed phone numbers, or information from the internet. Placement of the various elements in the PTT device 200 as shown in the figures is merely exemplary. The end device contains various communication components, for example, an internal transmitter and receiver.

Figure 3:
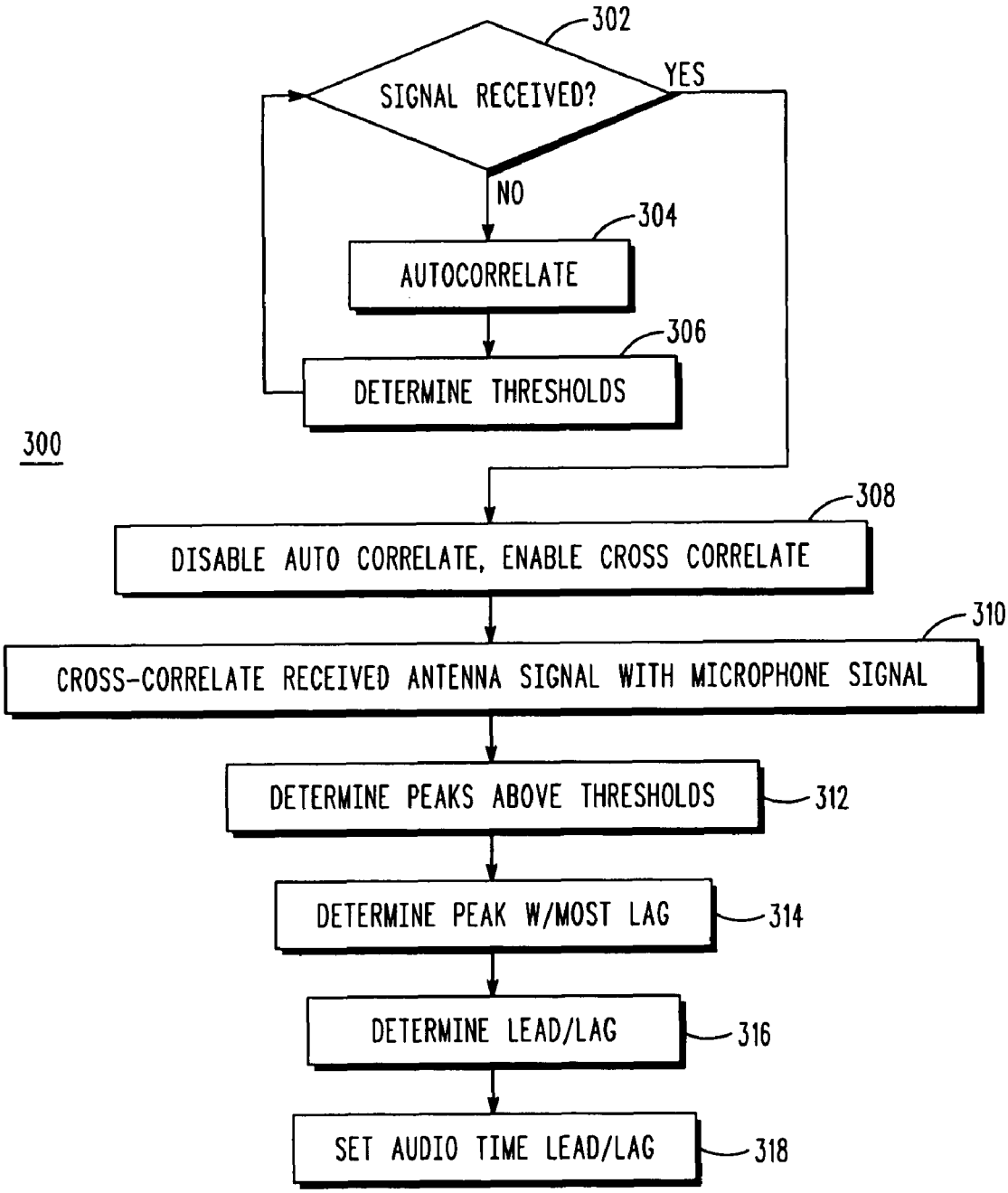
FIG. 3 is a flowchart illustrating one method of aligning an audio stream.

A method of time aligning group reproduction of an audio stream across homogeneous and heterogeneous end devices is shown in FIG. 3. This method is usable with a wide variety of Radio Area Network (RAN) technologies for transmission and reception. Such circuit-switched narrowband RAN technologies include 25 kHz, 12.5 kHz, or 6.25 kHz equivalent Time or Frequency Division Multiple Access (TDMA or FDMA) air interfaces (e.g. Project 25, TETRA, DMR). Example packet-switched broadband RAN technologies include LTE, UMTS, EVDO, WiMAX, 802.11, Bluetooth, and WLAN air interfaces.

Independent of the technology used, multiple end devices are collocated in a pack that reproduces the same talkburst from a transmitting end device. Each collocated end device receives the same reproduced talkburst from the neighboring receiving end devices and aligns its reproduced talkburst to that of its neighbors. The end devices may be portable, such as that shown in FIG. 2, or may be permanently positioned at the location of the incidence around which the collocated end devices are disposed.

As shown in FIG. 2, the end device contains one or more microphones 216. At least one of the microphones samples the talkburst while the end device is not transmitting (i.e. when the end device is in a listening/receiving mode). If only one sampling microphone is present, it may be oriented 180 degrees from the loudspeaker. For example, the sampling microphone may be disposed on the back of the end device 200, unlike the primary microphone 216 into which the user of the end device speaks. Both the sampling microphone and the primary microphone 216 may be employed to sample audio stream during autocorrelation and/or cross-correlation. Alternatively, sampling of the audio stream may avoid using the primary microphone 216 for efficiency reasons as well as the primary microphone 216 being subject to relatively large amounts of noise due to proximity to the user. The sampling microphone(s) may be oriented in other directions, e.g., on one or more of the sides of the end device 200. The addition of microphones adds sensitivity at the cost of using real estate in the end device 200 and increasing the expense and complexity of the end device 200.

FIG. 3 illustrates a flowchart for providing audio compensation from other end devices based on correlation. In the flowchart 300 of FIG. 3, it is determined in the end device (which is in a pack of end devices all receiving the same stream) whether an audio stream is received by the antenna. If an audio stream is not detected 302, the end device (also called the listening end device) operates in an auto-correlation mode 304 and determines any peaks that are above a threshold 306. If an audio stream is detected 302, the end device switches from auto-correlation mode into a cross-correlation mode 308. In the cross-correlation mode the end device cross-correlates the audio stream received by the antenna with over-the-air (OTA) audio streams received by the microphone 310. Over-The-Air (OTA) is a standard for the transmission and reception of application-related information in a wireless communications system. The OTA audio streams include audio reproduction of the antenna stream by other end devices in the pack. The listening end device determines if the cross-correlation peaks exceed the threshold previously determined in the auto-correlation mode 312 and, if so, determines the peak with the maximum lag 314. Such peaks thus correspond to audio reproduced by other end devices (that are close enough to the listening end device performing the correlation to be problematic due to volume of the reproduced audio from the other end devices). The peak with the maximum lag accordingly corresponds to the end device having the most delayed audio reproduction with respect to the listening end device. The lag is determined 316 and used to adjust the timing of the playout at the end device 318. This method is described in more detail below.

As used herein, the lagging device in the pack is the end device whose reproduced talkburst is heard last by listening end devices. The leading device is the end device whose reproduced talkburst is heard first by listening end devices. If both narrowband circuit-based and broadband packet-based end devices are present in the pack, audio delay in the broadband devices tends to be longer than in the narrowband devices. In one embodiment, the end devices in the pack align their reproduction with that of the lagging device. In this case, the end devices slow down their reproduction during the alignment process. Although this may increase end-to-end delay (i.e., delay between audio being received by the transmitter and being reproduced by the receiving end devices), this technique imposes no requirements on packet delivery time to each end device.

As all end devices are configured to align with the lagging end device, a unidirectional shift in time occurs when aligning to the lagging device. This unidirectional time shift ensures that the end devices do not oscillate indefinitely in attempts to synchronize with one another.

Specifically, in the embodiment described, the sampled audio received from the additional microphone on the $N^{th}$ end device when in listening mode is y(n). Assuming the end device receives compressed audio OTA in packets (e.g., the end device is a broadband IP device), the end device reconstitutes linear pulse code modulation (PCM) samples from the received compressed audio OTA, resulting in a sampled stream of PCM audio. This stream is denoted $x_i(n)$ (i being at the $i^{th}$ end device in the pack). Each of the devices (device, $device_2$, $device_3$, etc.) has a reconstituted stream $x_1(n)$, $x_2(n)$, $x_3(n)$, etc. Therefore, if $x_1(n)$ is being played out of $device_1$'s speaker; $x_1(n)$ is demodulated OTA audio that was sent to device, if $x_2(n)$ is being played out of $device_2$'s speaker; $x_2(n)$ is demodulated OTA audio that was sent to $device_2$, etc. This leads to the sampled audio y(n) being:

$$y(n)=x_1(n)+x_2(n)+x_3(n)+\ldots x_{N-1}(n)+n(n)$$

Where:

N−1=the number of devices in the pack within audible range of $x_N(n)$ n(n)=the sampled noise other than the audio from the transmitter being played out of each device. As n(n) is uncorrelated with $x_i(n)$, this audio will eventually be ignored.

The centralized infrastructure (e.g., the controller) selects the same source to be transmitted to all end devices associated with a given talkgroup. As device, $device_2$, $device_3$, . . . , $device_N$ are located within listening distance of each other, each end device receives the same audio from the base station at roughly the same bit error rate (BER). Each end device also applies roughly the same error mitigation to the received audio independent of the particular end device. Therefore, roughly the same audio is reproduced from multiple collocated device speakers, albeit slightly misaligned in time.

If $x_1(n)$ is the most time-lagging version of the audio (which is herein used as the reference), this gives:

$$x_2(n)=x_1(n-t_2)$$

$$x_3(n)=x_1(n-t_3)$$

$$\ldots$$

$$x_{N-1}(n)=x_1(n-t_{N-1})$$

$$x_N(n)=x_1(n-t_N)$$

Where:

$t_2=x_2(n)$'s phase offset with respect to $x_1(n)$ $t_3=x_3(n)$'s phase offset with respect to $x_1(n)$, . . . etc.

This yields:

$$y(n)=x_1(n)+x_1(n-t_2)+x_1(n-t_3)+\ldots x_{N-1}(n)+n(n)$$

Continuing, $device_N$ takes the cross-correlation of the reconstituted audio $device_N$ received OTA (i.e., $x_N(n)$) with audio sampled at $device_N$'s microphone (i.e. y(n)). The cross-correlation of $device_N$ is given by:

$$c_N(n) = \sum_{m=0}^{M} y(m) * x_N(n+m)$$

This is to say that the lag or advancement of $x_N(n)$ played out of the speaker of $device_1$ relative to the audio played out of $device_N$'s speaker is shown by a peak at $c_N(t_N)$, the lag or advancement of $x_N(n)$ played out of the speaker of $device_2$ relative to the audio played out of $device_N$'s speaker is shown by a peak at $c_N(t_N-t_2)$, . . . , etc. If no peaks are present in the cross-correlation (other than at $c_N(0)$), $x_2(n)$, $x_3(n)$, . . . ), $x_N(n)$ are sufficiently attenuated streams of audio. If $x_2(n)$, $x_3(n)$, . . . , $x_N(n)$ are sufficiently attenuated, the audio from these devices may not interfere with the listener at $device_1$'s ability to discern the usability of the $x_1(n)$ audio stream.

In addition to the audio stream being used for time alignment, noise (e.g. n(n)) common at both the source microphone of the transmitter and at the microphone where y(n) is sampled can serve to provide the common element for audio alignment.

To gauge the threshold used to distinguish the c(n) peaks, the noise floor f(0) can be determined by:

$$f(0) = \sum_{m=0}^{M} y(m) * y(m)$$

In the maximum term of the cross-correlation summation, the number of samples M is chosen to include the maximum possible differential delay. For example, if the differential audio processing delay incurred by varying unicast packet delay arrivals is 240 msecs, the differential processing delay is 10 msecs, and the PCM audio sample rate is 8 ksamples/sec, then M is at least: (0.24+0.01=0.250)×8000=2000 samples.

In the embodiment described, the lagging end device in the pack is the master to which all other radios time delay and align. In this case, after all of the c(n) values are accrued and the peaks are determined, the peak with the largest delay is chosen i.e., the peak whose t value is the largest. Upon determination that $t_N$ is the largest, $device_N$ then delays its audio $t_N$ samples to be aligned with $device_1$. Similarly, the $c_i(n)$ peaks for each end device cause the devices to shift their audio to the most lagging device. This causes a strong-cross correlation peak as the audio reproductions from various end devices shift to the audio reproduction with the greatest lag.

End devices can align their output waveforms one or more times per talkburst (i.e., at multiple times during a particular talkburst). Alternatively, the end devices can align their output waveforms once every predetermined number of talkbursts (e.g., every 2, 3, 4, etc. . . . talkbursts). Once the waveforms of the end devices are aligned with that of their neighbors, relative timestamps embedded in the steam (such as those provided by RTP or the circuit nature of LMR) generally continue to keep the waveform in alignment. Minor clock variances of a few tens of milliseconds are not noticeable, as the human brain generally ignores up to 30 ms of time offset (nominally delays of greater than about 50-100 ms are noticeable). End devices may attempt to maintain audio quality during the alignment process by employing known time compression and/or expansion techniques to fill/remove audio as desired over this relatively small interval while maintaining the integrity of the overall voice message.

When the end devices align their output waveforms, the alignment may be set to occur after a particular time period. In such an embodiment, an internal counter in the end device increments or decrements by a predetermined amount and then initiates autocorrelation at the next free time. Thus, for example, if the end device is receiving a talkburst or is otherwise occupied (e.g., performing maintenance), auto-correlation is not initiated until after the end of the talkburst or time period of being occupied. Such an embodiment also permits the temporal alignment to be maintained without additional processing if a call ends and the hang time (the time between the end of a talkburst and the beginning of the next talkburst of any users on the system) has not been exceeded.

During cross-correlation, assuming the end devices align to the lagging end device, the audio may slow down for a short amount of time until aligned with the lagging end device. This slowdown may provide a gradual transition to the lagging end device for the time period over which the alignment occurs (hereinafter referred to as the alignment time) so as to provide non-noticeable distortion of the audio. Alternatively, the audio for the lagging end device may be suspended for the time difference between the particular end device and the lagging end device to align the particular end device to the lagging end. The alignment time is thus dependent on the time difference between the lagging end device and the end device being synchronized to the lagging end device as well as the length of time to achieve the time difference (which depends on the amount of distortion desired).

In some embodiments, the audio is slowed down or suspended over a continuous period. In other embodiments, the slowdown or suspension may occur over a number of shorter intervals between successive talkbursts. This latter implementation extends the alignment time but can reduce noticeability to a user.

During the alignment time, the initial portion of the talkburst may be muddled by the unaligned pack audio. When alignment occurs, the initial portion of the talkburst used in the cross-correlation may be ignored by internal correction mechanisms—that is, the audio from misaligned end devices starts off muddled and transitions to aligned audio without changing the talkburst. In other embodiments, when alignment occurs, the talkburst may be restarted such that the initial portion of the talkburst is repeated and the talkburst continues after this repetition.

In another embodiment, if analysis of the cross-correlation determines that peaks above the threshold are present, the volumes of the end devices that are not the lagging end device are automatically muted or otherwise reduced to a level below that causing the associated peak to be greater than the threshold by an internal volume reduction mechanism in each of the end devices. The volume may gradually increase from the reduced level in proportion with decreasing time shift from the lagging end device or may increase to the initial volume setting on each of the end devices once alignment is completed.

In some cases, the end devices may contain a locator such as a Global Positioning System (GPS) unit embedded therein. The use of locators may be relatively expensive and bulky, as well as being dependent on maintaining constant visibility to a satellite constellation. While these problems make it impractical to equip all end devices with locators, nevertheless, locators are being incorporated to a greater and greater extent in various end devices.

For each end device in the pack that contains such a locator, the locator may be used in conjunction with the cross-correlation to provide time alignment and/or volume control. Such an embodiment may be useful, for example, if the microphone(s) of a particular end device that capture the cross-correlation audio becomes muffled. In this case, although the loudspeakers from other end devices in the pack may be broadcasting loudly enough to normally cause the peaks to be above threshold (and thus the reproduced audio from these end devices to be audible to other users), the peaks may appear to be below threshold. This leads to the end device with the muffled microphone remaining unaligned and consequently being a distraction.

Such a problem may be alleviated if a locator is used. For example, the use of the locator permits the threshold to be adjusted for end devices that are within a predetermined radius of other end devices in the pack. The volume of the other end devices may also be reduced so long as they are within the particular radius. Further, a ripple-type effect during time alignment may occur with increasing distance from the lagging end device if not all of the end devices in the pack produce peaks that are above threshold. The use of a locator may avoid such a problem, permitting simultaneous time alignment for all of the end devices in the pack.

In certain circumstances, it may be desirable to use multiple cross-correlations. For example, while the frequency response characteristics of I/O devices (e.g., microphones, loudspeakers) do not tend to vary greatly for individual end devices of the same family of devices (e.g., PTT end devices supplied by a particular company or manufacturer), these characteristics may vary significantly more between different families of end devices especially as different I/O devices are used. As the thresholds may thus differ, it may be desirable in one embodiment to run different cross-correlations for a selected number of families of devices dependent on the different frequency response characteristics of the I/O devices.

As above, each end device may contain one or more internal receivers and one or more microphones. At least one of the microphones is used for noise cancellation. In one embodiment, the internal receivers and the cancellation microphone are sources of audio streams (hereinafter referred to as audio channels). Only one audio channel (except that from the cancellation microphone) may be the primary audio channel which sources the primary audio stream. The primary audio stream contains the audio presented to the subscriber user. The primary audio stream is used as the reference for the correlation algorithm. Also the primary audio may be attenuated (the attenuationFactor can be between 0 and 1 inclusive and is multiplied times each sample in the primaryAudioStream). The goal is to determine if an audio stream is present on an audio channel and the primary audio channel. If a stream is present on an audio channel and the stream on the audio channel is considered proximally close enough to affect the audio quality of the primary audio, a compensation algorithm (correlation or attenuation) is run on the primary audio stream.

Figure 4:
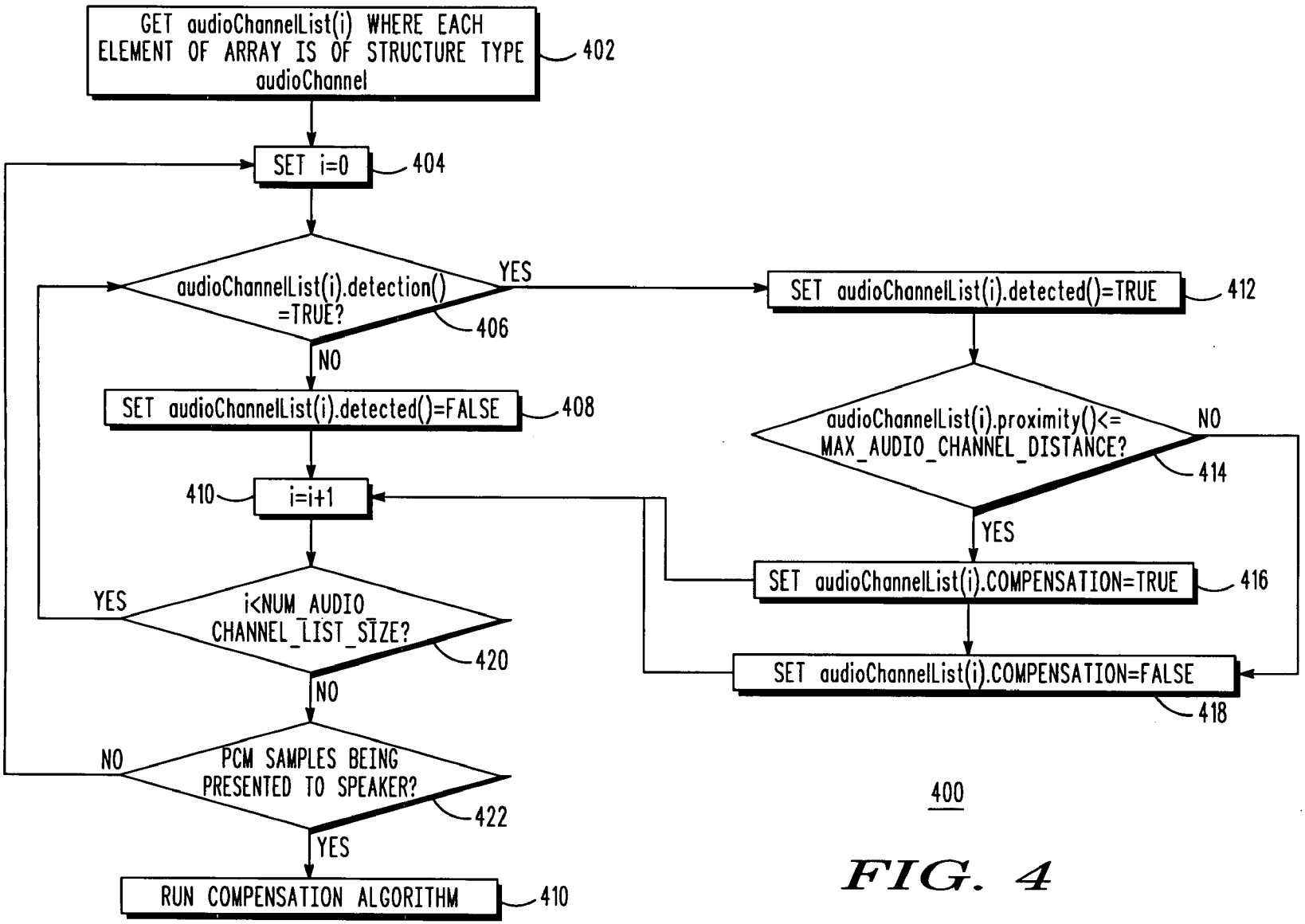
FIG. 4 is a flowchart illustrating one method of determining whether to apply compensation.
Figure 5:
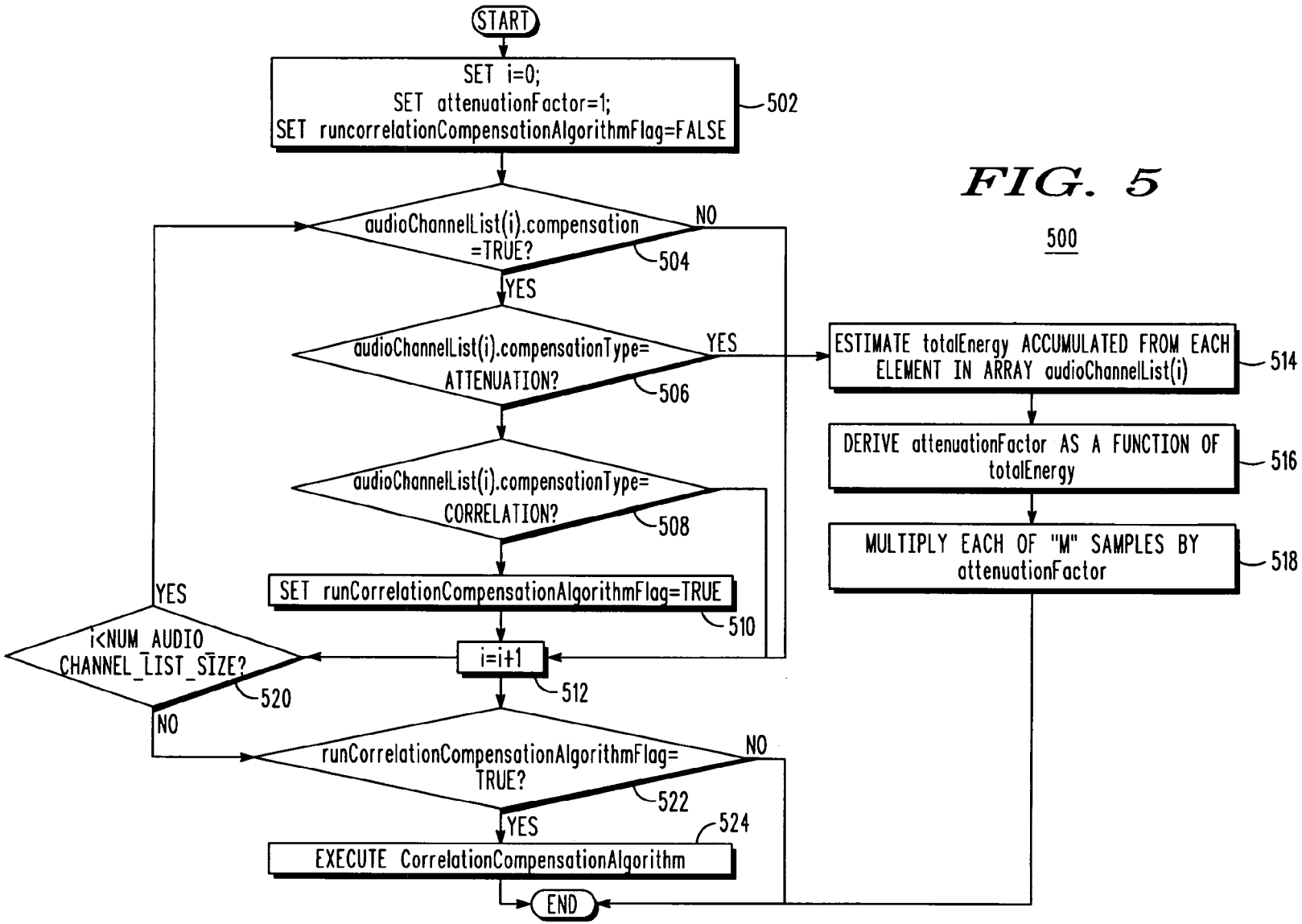
FIG. 5 is a flowchart illustrating one method of determining which type of compensation, if desired, to apply.

FIGS. 4 and 5 are flowcharts that illustrate an algorithm used to provide compensation when desired. As used in FIGS. 4 and 5, an audio stream (audioStream) contains "M" or "K" sequential PCM audio samples. An audio channel (audioChannel) is a source of a received audioStream from the perspective of a subscriber. This may be, for example, a receiver or a microphone on the subscriber. The received audio stream is not the primary audio stream (primaryAudioStream) which is presented to the speaker but incidental audio noise that is to be compensated for by the subscriber. The primaryAudioStream is the audio stream to be presented to the speaker and intended to be heard by the user. The primaryAudioStream is received over a broadband or narrowband network.

In FIGS. 4 and 5, audioChannelList(i) is an array of audioChannel structures that logically describes the state of each audioChannel. NUM_AUDIO_CHANNEL_LIST_SIZE is the number of audio channels available on the subscriber, e.g., one Bluetooth receiver, one 802.11 receiver, one WiMAX receiver, and one noise cancelling microphone would set NUM_AUDIO_CHANNEL_LIST_SIZE=4. audioChannelList(i).detection( ) is the signal processing function used to detect signal presence or audio stream presence on audioChannel "i." audioChannelList(i).detected is a Boolean TRUE or FALSE. This is the state indicator for presence of a stream for audioChannel "i." audioChannelList(i).proximity( ) is the signal processing function used to detect the proximity for the physical signal source (i.e., audio stream) detected on the given audioChannel. This AudioStream has been detected on audioChannel "i." The term "proximity" indicates that the AudioStream detected on the audio channel negatively impacts the user's experience of the primaryAudioStream. MAX_AUDIO_CHANNEL_DISTANCE is the distance between the subscriber and the physical signal source less than for which negative impact of the user's experience of the primaryAudioStream occurs.

In FIG. 5, audioChannelList(i).compensation is a Boolean TRUE or FALSE. This is the state indicator to trigger compensation for the stream being detected on audioChannel "i." audioChannelList(i).compensationType is the type of compensation used for the stream being detected on audioChannel "i." Currently two types are described: ATTENUATION, which calculates a fraction between 0 and 1, inclusive, to be multiplied to each sample of the primaryAudioStream and CORRELATION, which describes the correlation compensation algorithm (correlationCompensationAlgorithm) below. attenuationFactor is the fraction used in ATTENUATION. totalEnergy is the total amount of audio energy present (environmental noise estimate) in the environment of the subscriber user. The attenuationFactor increases with increasing totalEnergy. runCorrelationCompensationAlgorithmFlag is a Boolean TRUE or FALSE. This is the state indicator to trigger the CORRELATION compensation algorithm assuming no audioStream whose audioChannelList(i).compensationType=ATTENUATION is in proximity. Although not shown in FIGS. 4 and 5, all Boolean values are initialized to FALSE.

The algorithm 400 of FIG. 4 begins when an internal processor of the subscriber creates an array (audioChannelList(i)) describing the state of each audio channel at step 402. This state includes whether an audio stream has been detected on the audio channel, whether the audio stream on the audio channel is considered proximate to the subscriber, and, if proximate, sets the channel compensation flag. The array also has a detection function to determine whether an audio stream is present on the audio channel and a function to determine whether the audio detected on that channel is considered proximate to the subscriber (i.e., enough to impact user experience). The remainder of the algorithm in FIG. 4 seeks to determine the values for those state variables and then automatically run the compensation algorithm 500 in FIG. 5. To this end, the "i" value is set to the initial value (0) at step 404 and it is determined whether an audio stream is detected at the first audio channel at step 406. If no audio stream has been detected, audioChannelList(0).detected is set to FALSE at step 408 and "i" is incremented at step 410.

If an audio stream has been detected, audioChannelList(0).detected is set to TRUE at step 412. If an audio stream has been detected at step 412, at step 414, whether the audio stream source is at most MAX_AUDIO_CHANNEL_DISTANCE is determined. If it is not greater than MAX_AUDIO_CHANNEL_DISTANCE, then audioChannelList(i).compensation is set to TRUE at step 416 and if it is greater than MAX_AUDIO_CHANNEL_DISTANCE, then audioChannelList(i).compensation is set to FALSE at step 418. After setting audioChannelList(i).compensation at either step 416 or 418, "i" is incremented at step 410.

After incrementing "i" at step 410, at step 420 the algorithm 400 determines whether any other audio stream sources (audio channels) are present in the array. Thus, at step 420, the current value of "i" (after being incremented at step 410) is compared with the value of NUM_AUDIO_CHANNEL_LIST_SIZE. If it is determined that the current value of "i" is less than NUM_AUDIO_CHANNEL_LIST_SIZE at step 420 (i.e., more audio channels are present), then the algorithm 400 returns to step 406 for the new audio channel. If it is determined that the current value of "i" is not less than NUM_AUDIO_CHANNEL_LIST_SIZE at step 420 (i.e., no more audio channels are present), then it is determined at step 422 whether a primary audio stream is being presented to the speaker for audio reproduction. If at step 422 it is determined that a primary audio stream is not being presented to the speaker for audio reproduction, the algorithm 400 returns to step 404. If at step 422 it is determined that a primary audio stream is being presented to the speaker for audio reproduction, at step 424 the algorithm 400 runs the compensation algorithm of FIG. 5 and then returns to step 404.

The compensation algorithm 500 of FIG. 5 seeks to determine if there is at least one audio channel for which it would be desirable that the attenuation compensation algorithm be run. If at least one such channel is detected, the attenuation compensation algorithm is run rather than the correlation compensation algorithm. If the attenuation function is not desired but it is desired to run the correlation function for at least one audio channel, then the correlation function is run. If there are no proximate audio streams, no compensation is run.

Turning to FIG. 5, the compensation algorithm 500 begins by reinitializing "i" (i.e., setting the value of "i" to 0) and setting a default to not run the correlation compensation algorithm (i.e., setting runCorrelationCompensationAlgorithmFlag to FALSE) both at step 502. The compensation algorithm 500 determines whether the first audio channel is to be compensated at step 504. To accomplish this, the value of audioChannelList(i).compensation for the first audio channel is checked at step 504. If no compensation is to be provided for the first audio channel (i.e., the value of audioChannelList(i).compensation is FALSE), the value of "i" is incremented at step 512. If compensation is to be provided for the first audio channel (i.e., the value of audioChannelList(i).compensation is TRUE), the type of compensation is to be applied is determined as preconfigured when the radio is shipped. At step 506, it is determined whether attenuation is to be applied by determining if audioChannelList(i).compensationType=ATTENUATION. If it is determined that attenuation is to be applied at step 506, the total energy from all audio channels (totalEnergy) is calculated at step 514, an attenuation factor (attenuationFactor) is derived from the total energy at step 516, and the attenuation factor is applied to each sample in the audio stream for each audio channel at step 518 and the compensation algorithm 500 terminates.

If it is determined that attenuation is not to be applied at step 506, it is determined whether correlation is to be applied by determining if audioChannelList(i).compensationType=CORRELATION at step 508. If it is determined that correlation is not to be applied at step 508, the correction algorithm 500 proceeds to step 512, where the value of "i" is incremented. If it is determined that correlation is to be applied at step 508, the correction algorithm 500 sets runCorrelationCompensationAlgorithmFlag to TRUE at step 510 and then continues to step 512, where the value of "i" is incremented.

After incrementing "i" at step 512, at step 520 the compensation algorithm 500 determines whether any other audio stream sources (audio channels) are present in the array. Thus, at step 520, the current value of "i" (after being incremented at step 512) is compared with the value of NUM_AUDIO_CHANNEL_LIST_SIZE. If it is determined that the current value of "i" is less than NUM_AUDIO_CHANNEL_LIST_SIZE at step 520 (i.e., more audio channels are present), then the compensation algorithm 500 returns to step 504 for the new audio channel to determine whether the new audio channel is to be compensated. If it is determined that the current value of "i" is not less than NUM_AUDIO_CHANNEL_LIST_SIZE at step 520 (i.e., no more audio channels are present), then it is determined at step 522 whether correlation is to be applied (i.e., runCorrelationCompensationAlgorithmFlag is TRUE) for any audio channel. In other words, the loop goes through and determines if at least one event exists where runCorrelationCompensationAlgorithmFlag should be set to True. In other words, the loop goes through every element in the audioChannelList looking for at least one in which the CorrelationCompensationAlgorithm is to be run. Once set to True in the loop, the flag remains True. The flag can thus be set to False (i.e., set to True zero times) or set to True (i.e., set to True once, twice, thrice, etc.). The box 522 checks to see if the runCorrelationCompensationAlgorithmFlag was set to True at least once. If it is determined at step 522 that correlation is not to be applied (i.e., the flag is False), the compensation algorithm 500 terminates. If it is determined at step 522 that correlation is to be applied (i.e., the flag is True), the correlation compensation algorithm (delay sensitive or delay-insensitive as programmed) is executed at step 524 before the compensation algorithm 500 terminates.

Figure 6:
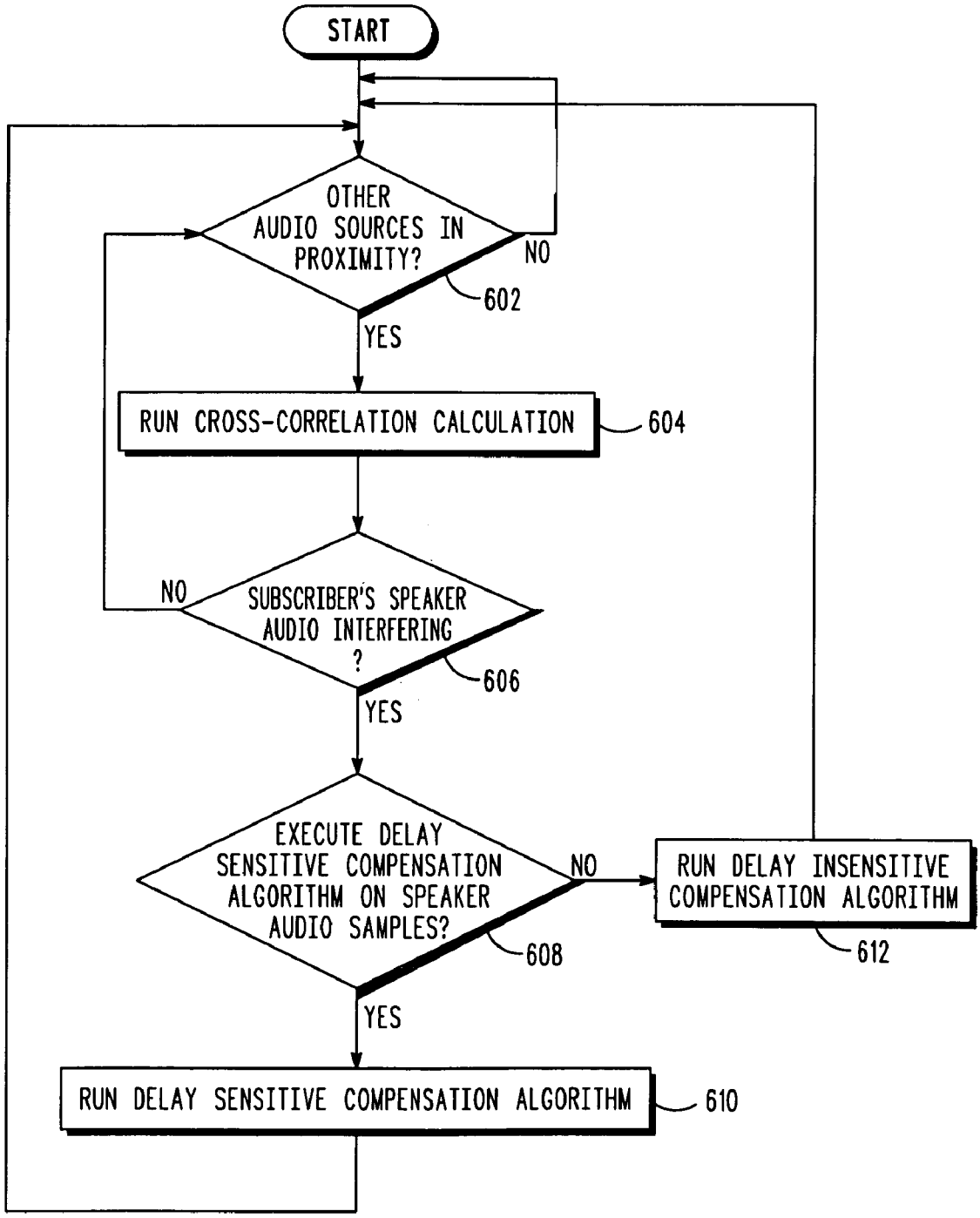
FIG. 6 is another flowchart illustrating one method of aligning an audio stream.

Another flowchart of a method of compensating for temporally misaligned audio in an end device is shown in FIG. 6. In the method 600 shown in FIG. 6, the end device continually determines whether other audio sources are in proximity at step 602 using one or more of the microphones of the end device once an audio signal is received. If one or more audio sources are in proximity, the processor in the end device performs a cross-correlation calculation 604. Using the result of this calculation, the processor determines whether its own speaker audio is interfering 606 (i.e., has a sufficiently different phase delay from that of at least one of the other audio sources). If it is not interfering, the end device returns step 602. If it is interfering, the processor determines whether a delay sensitive compensation algorithm is to be used on its own speaker audio 608. If so, the processor applies a delay sensitive compensation algorithm on its own speaker audio 610, reproduces the speaker audio, and then returns to step 602. If not, the processor applies a delay insensitive compensation algorithm on its own speaker audio 612, reproduces the speaker audio, and then returns to step 602.

Activation and deactivation of the correlation features described herein may further be provided. Selection may be provided by an input on the end device and thus set by the user of the particular end device. Alternatively, the selection may be set externally, e.g., by the user that initiated the talkgroup, the leader of the talkgroup, a talkgroup configuration, or a default server setting. Selection may thus be effective on a call-to-call basis or for an extended period of time. In the event that multiple conflicting selections exist, selection priorities may be pre-established and stored in the server or end device to determine which selection is to be used.

Although OTA streams have been described herein, similar techniques may be used for signals provided via other short range communication paths. For example, a PAN using short range communications such as WiFi or Bluetooth connections may be used for time alignment instead of OTA audio. End devices employing this connectivity may provide a beacon or announcement for time alignment prior to an actual audio stream being reproduced by the end devices in the pack.

Although audio transmissions have been described herein, similar techniques may be used for other media presentations. The media transmissions may contain audio, in which case the OTA method described above may be used. Alternatively, if beacons/announcements are used, the media transmissions may be provided without audio. The use of the algorithms may depend on the system. For example, as time shifting adds audio throughput delay, it may be more useful for more delay insensitive systems. Attenuation, on the other hand, may be a better to use for audio throughput delay sensitive systems.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Those skilled in the art will recognize that a wide variety of modifications, alterations, and combinations can be made with respect to the above described embodiments without departing from the spirit and scope of the invention defined by the claims, and that such modifications, alterations, and combinations are to be viewed as being within the scope of the inventive concept. Thus, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by any claims issuing from this application and all equivalents of those issued claims.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A method of coordinating audio reproduction in collocated subscribers each containing an antenna, a loudspeaker, and a microphone, the method comprising at least one of the subscribers:

receiving an audio stream via the antenna;

producing an audio output from the loudspeaker based on the audio stream;

determining whether to provide cross-correlation and, if so, cross-correlating the audio stream with another audio output detected through the microphone from another of the collocated subscribers, the other collocated subscriber providing the other audio output in response to receiving the audio stream;

determining whether to adjust a phase of the audio output; and if the phase is to be adjusted, adjusting timing of the audio output based on the cross-correlation to reduce a phase offset between the audio output and the other audio output.

2. The method of claim 1, wherein the determining whether to adjust the audio output phase comprises determining that the phase offset is greater than a delay-sensitive compensation lag threshold based on the cross-correlation.

3. The method of claim 1, wherein the determining whether to adjust the audio output phase comprises determining that any phase offset is present based on the cross-correlation.

4. The method of claim 1, further comprising the at least one of the subscribers auto-correlating prior to the audio stream being received, the auto-correlation comprising detecting a noise signal through the microphone and determining a threshold based on the noise signal, the timing being adjusted based on positions of peaks in the cross-correlation that are above the threshold.

5. The method of claim 4, wherein the at least one of the subscribers further comprises a locator disposed therein, the method further comprising the at least one of the subscribers:

determining whether the at least one of the subscribers is in a predetermined radius of the other of the collocated subscribers, the other of the collocated subscribers lagging the at least one of the subscribers; and if the at least one of the subscribers is in a predetermined radius of the other of the collocated subscribers and the peaks do not exceed the threshold, reducing the threshold to a reduced threshold such that the timing is adjusted based on the positions of the peaks that are above the reduced threshold.

6. The method of claim 1, wherein adjusting the timing comprises aligning the subscriber to a lagging subscriber of the collocated subscribers.

7. The method of claim 1, wherein the alignment occurs between each pair of successive audio streams.

8. The method of claim 1, wherein the alignment occurs at predetermined time periods and, if the predetermined time period occurs during reception of a particular audio stream, the alignment occurs after the particular audio stream terminates.

9. The method of claim 1, wherein, if the other of the collocated subscribers lags the at least one of the subscribers, the alignment comprises the audio output of the at least one of the subscribers slowing down until the audio output of the at least one of the subscribers and the other of the collocated subscribers are temporally aligned.

10. The method of claim 1, wherein, if the other of the collocated subscribers lags the at least one of the subscribers, the alignment comprises the audio output of the at least one of the subscribers being suspended until the audio output of the at least one of the subscribers and the other of the collocated subscribers are temporally aligned.

11. The method of claim 1, wherein, if the other of the collocated subscribers lags the at least one of the subscribers, the alignment comprises the audio output of the at least one of the subscribers being slowed down or suspended until the audio output of the at least one of the subscribers and the other of the collocated subscribers are temporally aligned, the slowdown or suspension occurring over a number of intervals in between successive audio streams.

12. The method of claim 1, further comprising continuing to produce the audio output of the at least one of the subscribers after an initial portion of the audio output of the at least one of the subscribers during the alignment is provided without replaying the initial portion.

13. The method of claim 1, further comprising, if the other of the collocated subscribers lags the at least one of the subscribers and the phase is to be adjusted, reducing a volume of the audio output of the at least one of the subscribers until the phase offset is less than a threshold.

14. The method of claim 1, further comprising the at least one of the subscribers filtering the cross-correlation such that the cross-correlation and alignment occurs only for audio streams that correspond to transmission from a predetermined source.

15. The method of claim 1, further comprising externally activating and deactivating the cross-correlation and temporal alignment for the at least one of the subscribers.

16. The method of claim 1, wherein the at least one of the subscribers comprises a user microphone and a sampling microphone disposed on a different face of the at least one of the subscribers as the user microphone, the sampling microphone being employed to sample the other audio output during the cross-correlation.

17. A method of coordinating audio reproduction in collocated subscribers, the method comprising at least one of the subscribers:

determining a state of each audio channel of the at least one of the subscribers, each audio channel being a different receiver in the at least one of the subscribers, the state of a particular audio channel being determined by whether an audio stream has been detected on the particular audio channel and if so whether a source of the audio stream on the audio channel is proximate to the at least one of the subscribers;

determining whether one of the audio streams is a primary audio stream to be presented to a loudspeaker of the at least one of the subscribers for audio reproduction;

if one of the audio streams is the primary audio stream and the source of the primary audio stream is proximate to the at least one of the subscribers, determining whether to provide correlation; and if correlation is to be provided, cross-correlating the one of the audio streams with the primary audio stream to be presented to the loudspeaker of the at least one of the subscribers for audio reproduction, determining whether to adjust a phase of the audio reproduction from the at least one of the subscribers, and if the phase is to be adjusted, adjusting timing of the audio reproduction based on the cross-correlation to reduce a phase offset between the audio reproduction and the one of the audio streams.

18. The method of claim 17, further comprising, prior to determining whether to provide correlation:

determining whether to attenuate any of the audio streams on the audio channels of the at least one of the subscribers and, if so:

calculating a total energy from all audio channels;

deriving an attenuation factor based on the calculated total energy; and applying the attenuation factor to each sample in the audio stream for each audio channel to attenuate every audio stream; and only if none of the audio streams are to be attenuated, determining whether to provide correlation.

19. A device comprising:

an antenna configured to receive an audio signal;

a loudspeaker configured to produce an audio output in response to the audio signal;

a plurality of microphones including a user microphone and a sampling microphone disposed on a different face than the user microphone; and a processor that is configured to auto-correlate noise received by the sampling microphone to provide a threshold prior to the antenna receiving the audio signal, cross-correlate the audio output with other audio outputs detected from other devices through the sampling microphone, the other devices providing the other audio outputs in response to receiving the audio signal, and adjust the audio output to reduce a phase offset between the audio output of the device with the other audio outputs.

20. The device of claim 19, wherein the processor is configured to reduce the phase offset only if the phase offset is greater than about 30 mS.

* * * * *

UNITED STATES PATENT AND TRADEMARK OFFICE

CERTIFICATE OF CORRECTION

PATENT NO. : 8,111,843 B2
APPLICATION NO. : 12/268864
DATED : February 7, 2012
INVENTOR(S) : Logalbo et al.

It is certified that error appears in the above-identified patent and that said Letters Patent is hereby corrected as shown below:

In the Drawings:

In Fig. 4, Sheet 4 of 6, delete Tag "410" and insert Tag -- 424 --, therefor.

In Fig. 6, Sheet 6 of 6, insert -- 600 -- above the Figure.

Signed and Sealed this
Thirteenth Day of August, 2013

Teresa Stanek Rea
*Acting Director of the United States Patent and Trademark Office*